US011426624B1

(12) United States Patent
Reisinger, Jr.

(10) Patent No.: US 11,426,624 B1
(45) Date of Patent: Aug. 30, 2022

(54) ROLLABLE EXERCISE APPARATUS

(71) Applicant: Leonard Reisinger, Jr., Nampa, ID (US)

(72) Inventor: Leonard Reisinger, Jr., Nampa, ID (US)

( * ) Notice: Subject to any disclaimer, the term of this patent is extended or adjusted under 35 U.S.C. 154(b) by 0 days.

(21) Appl. No.: 17/705,242

(22) Filed: Mar. 25, 2022

Related U.S. Application Data

(60) Provisional application No. 63/166,079, filed on Mar. 25, 2021.

(51) Int. Cl.

| | |
|---|---|
| ***A63B 22/20*** | (2006.01) |
| ***A63B 21/00*** | (2006.01) |
| ***A63B 21/072*** | (2006.01) |
| ***A63B 23/02*** | (2006.01) |

(52) U.S. Cl.
CPC ..... *A63B 22/20* (2013.01); *A63B 21/072* (2013.01); *A63B 21/4035* (2015.10); *A63B 23/02* (2013.01)

(58) Field of Classification Search
CPC ... A63B 21/072; A63B 21/4035; A63B 23/02; A63B 21/0004; A63B 21/02; A63B 21/04; A63B 21/0407; A63B 21/0428; A63B 21/05–0557; A63B 21/06; A63B 21/0724; A63B 21/0726; A63B 21/4043; A63B 22/0002; A63B 22/20–205; A63B 23/0211; A63B 23/035–03516; A63B 23/03541; A63B 23/12; A63B 23/1209; A63B 23/1236; A63B 2209/08; A63B 22/16; A63B 26/003; A63B 69/0093
See application file for complete search history.

(56) References Cited

U.S. PATENT DOCUMENTS

| | | | | |
|---|---|---|---|---|
| 5,358,463 | A * | 10/1994 | Fuentes | A63B 23/12 482/141 |
| 9,199,117 | B1 * | 12/2015 | Nicholas | A63B 21/068 |
| 9,358,419 | B1 * | 6/2016 | Smith | A63B 23/1209 |
| 9,770,619 | B1 * | 9/2017 | Bullock | A63B 65/06 |
| 9,789,359 | B2 * | 10/2017 | Sassano | A63B 21/068 |
| 2004/0142802 | A1 * | 7/2004 | Greenspan | A61H 1/0237 482/146 |
| 2009/0298656 | A1 * | 12/2009 | Dannenberg | A63B 22/14 482/141 |
| 2012/0083397 | A1 * | 4/2012 | Meininger | A63B 23/03541 482/132 |
| 2012/0252645 | A1 * | 10/2012 | Agostini | A63B 26/003 482/132 |
| 2013/0023391 | A1 * | 1/2013 | Nicholas | A63B 21/0004 482/132 |

(Continued)

*Primary Examiner* — Joshua Lee
*Assistant Examiner* — Catrina A Letterman
(74) *Attorney, Agent, or Firm* — Burdick Patents, P.A.; Sean D. Burdick

(57) ABSTRACT

A rollable exercise device is formed as a carriage having multiple sides, a main bearing embedded in a concave center, and a removably insertable weight with gripping handle. The main bearing facilitates rolling engagement with the weight and allows for dynamic adjustment of gripping angle relative to the carriage. A bottom surface of the carriage supports a plurality of rollerballs by means of bearings that facilitate omnidirectional rolling engagement of the carriage on a planar surface. Components may be embedded into the sides for attaching external equipment or to attach the device in tandem to a similar device.

20 Claims, 7 Drawing Sheets

(56) References Cited

U.S. PATENT DOCUMENTS

| | | | | |
|---|---|---|---|---|
| 2013/0123079 | A1* | 5/2013 | Peritz | A63B 22/18 482/139 |
| 2013/0190150 | A1* | 7/2013 | Delisle | A63B 23/1236 482/141 |
| 2014/0038795 | A1* | 2/2014 | Sassano | A63B 22/18 482/141 |
| 2016/0089576 | A1* | 3/2016 | Rosenstiel | A63B 21/0407 482/146 |
| 2017/0266489 | A1* | 9/2017 | Douglass | A63B 21/068 |
| 2017/0304675 | A1* | 10/2017 | Panes | A63B 23/0216 |
| 2018/0036588 | A1* | 2/2018 | Brown | A63B 23/03541 |
| 2020/0376331 | A1* | 12/2020 | Moridaira | A63B 22/20 |
| 2021/0394012 | A1* | 12/2021 | Agostini | A63B 22/18 |

* cited by examiner

ROLLABLE EXERCISE APPARATUS

CROSS-REFERENCE TO RELATED APPLICATIONS

This application claims priority to U.S. Provisional Application No. 63/166,079, filed Mar. 25, 2021, the disclosure of which is incorporated herein by reference.

FIELD OF THE INVENTION

The present invention relates generally to exercise equipment, and more specifically to floor-based training equipment for stretching and resistance exercises.

BACKGROUND OF THE INVENTION

Regular exercise is an important aspect of daily life for many people. Regular exercise is known to help a person manage their weight. Exercising regularly has also long been known to reduce certain health risks and improve the overall health and quality of life for people. In particular, regular exercise has been known to lower the risk of heart attacks and heart disease, lower the risk of type 2 diabetes, and even can have a positive impact on a person's blood pressure. In addition to the physical benefits, exercising regularly is known to have certain mental health benefits as well. Regular exercise can result in a person having more energy throughout the day and increase a person's overall mood. Exercising regularly has also been shown to reduce depression and improve sleep quality for a person.

Despite all the known physical and mental benefits to exercising regularly, it is oftentimes difficult for people to accomplish for one reason or another. One obstacle that many may face when attempting to exercise regularly is access to exercise equipment or facilities. Further, many people might decide they do not have the time to go to a gym or other facility to exercise. This issue may be common for people with busy daily schedules or people who are constantly traveling for work or pleasure. Another obstacle people may face is the sheer lack of knowledge of how to correctly and effectively exercise without causing themselves injury.

In response to these above obstacles and others, there have been many different types of personal, at-home exercise equipment that has been developed. This equipment can be large complex cable machines, similar to those commonly found in exercise facilities. Generally, the more complex the machine, the greater the risk of injury. Other at-home exercise equipment may be less complex and safer, such as a medicine ball or resistance bands. However, the exercises a person is capable of performing with simple devices are limited.

Another class of personal exercise equipment designed for at-home use includes apparatus mounted on rollers that are designed to assist the user with various stretching exercises as the apparatus is rolled back and forth along the exercise floor. These devices enable the user to perform core-strengthening exercises in all planes of human motion—frontal, sagittal, and transverse. However, rolling exercise apparatus can be inherently dangerous, as users are susceptible to injury from loss of control or improper use. In particular, rolling apparatus equipped with fixed handles can cause arm or wrist injuries as the rolling platform stretches the human arm to its limit.

What is needed is a safe and easy-to-use personal exercise device suitable for at-home use that can be combined with other exercise equipment and provide a user with many options when exercising.

SUMMARY OF THE INVENTION

In broad terms, the inventive concepts disclosed herein relate generally to a rollable exercise apparatus having a removably insertable weight. The weight can be designed with a removably insertable handle with a grip. When inserted, the handle freely rotates for angular adjustment of the grip. The exercise apparatus is designed for omnidirectional rolling engagement with a planar surface.

In a preferred embodiment, the exercise apparatus includes a carriage having at least three sides that surround a top and bottom surface. The top surface of the carriage has a concave center designed to receive an insertable weight. Positioned in the inferior end of the concave center is a main bearing. The weight is configured for rolling engagement with the main bearing. The exercise apparatus further includes at least one rollerball partially encased in a rollerball housing formed in a bottom side of the carriage. The rollerball housing has at least one support bearing on its bottom surface configured for rolling engagement with the rollerball. In a preferred embodiment, there are three rollerballs, each partially encased in its own rollerball housing.

In a preferred embodiment, the weight has a hemispherical shape. The concave center also has a hollow hemispherical shape corresponding to that of the removable weight. Alternative shapes of the weight and corresponding concave center may also be used. The weight may be inserted into the concave center to provide a means for gripping the exercise apparatus, or the weight may be removed and used for separate exercises.

In one embodiment, the main bearing comprises a plurality of bearing balls. The plurality of bearing balls is configured to engage the weight when positioned in the concave center and facilitate the rolling engagement between the weight and the carriage.

In one embodiment, the support bearing on the bottom surface of the apparatus comprises of a plurality of bearing balls. The plurality of bearing balls is configured to facilitate rolling engagement with the rollerball. The rollerball housings may further include an optional band positioned on the lower end of the rollerball housing. In an alternative embodiment, the support bearing comprises a sleeve bearing configured to facilitate rolling engagement with the rollerball.

In alternative embodiments, the rollerball housing has at least two support bearings. A first support bearing is positioned superior to a center point of the rollerball and a second support bearing is positioned inferior to the center point. In one such alternative embodiment, at least one of the support bearings comprises a plurality of bearing balls. In another such alternative embodiment, at least one of the support bearings comprises a sleeve bearing.

Preferably, each side of the carriage is designed with an embedded component. One side may include one or more embedded strong earth magnets. Another side may include one or more embedded ferrous metal strips. Still another side may include an attachment point configured to attach an external piece of exercise equipment, such as a resistance band. In another embodiment of the present invention, each side of the carriage is designed with a different embedded component such that each side is functionally distinct from the others. Alternatively, each side of the carriage may be designed with the same embedded component such that all sides are functionally the same. Two such apparatus similarly configured may be coupled in tandem using the attachment points, or attraction between the magnets and metal strips.

In a preferred embodiment, the carriage has three sides that form an equilateral triangle. In this embodiment, the carriage has three rollerballs each positioned at a point on the equilateral triangle.

In one embodiment, the weight has a removable handle. The removable handle of the weight may be designed as a kettlebell handle. In another embodiment, the removable handle of the weight may be designed as a flat top handle. In yet another embodiment, the removable handle of the weight may be designed as a joystick handle.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the description of the preferred embodiments are to be regarded as illustrative in nature, and not as restrictive in nature.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments of an apparatus for performing floor-based stretching and resistance exercises.

Figure 1:
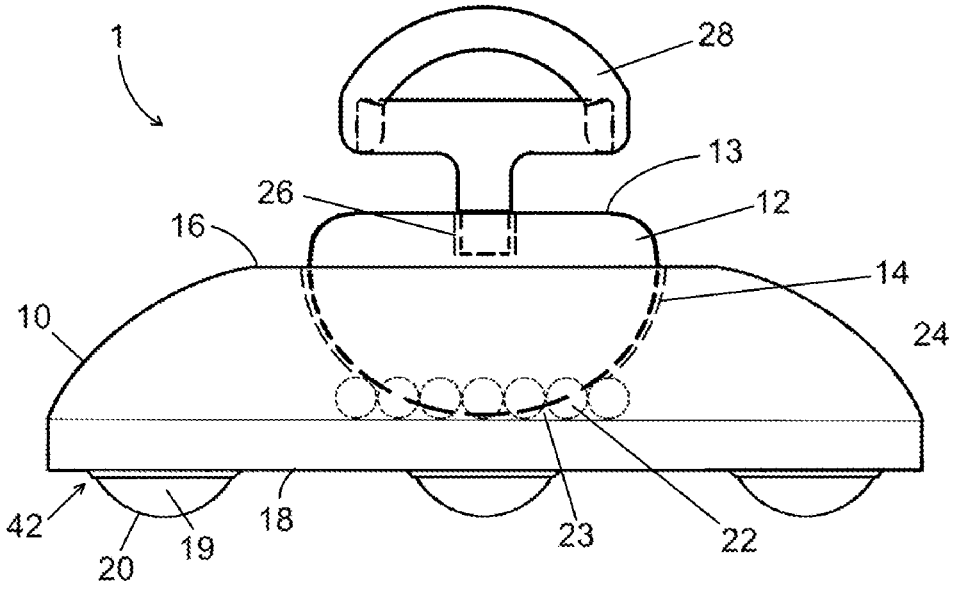
FIG. 1 is a partially transparent side view of one embodiment according to the invention of a rollable exercise apparatus.

FIG. 1 is a partially transparent side view of one embodiment of the exercise device 1. The exercise device 1 has a carriage 10. Preferably, the carriage 10 has at least three sides, described in more detail below. The carriage may be constructed from a hard, durable plastic material or may be made from a lightweight, durable metal material. Alternatively, the carriage may be constructed from a heavier metal material such that the carriage itself has a sufficient weight to it. However, other carriage shapes having more or fewer sides may also be used without departing from the scope of the invention. In a preferred embodiment, the sides of the carriage 10 are configured to form an equilateral triangle. The sides of the carriage surround a top surface 16 and a bottom surface 18. In one embodiment, the top surface is angled downward toward the sides, in an almost pyramid-like configuration without the top of the pyramid being formed. The angled top surface can minimize the potential for injury by discouraging a user from stepping on the device and it rolling out from underneath them. The angle is such that a user's foot might simply slide off to a side should a user accidentally step on the device.

The top surface 16 of the carriage 10 has a concave center 14 defined therein. The concave center 14 is configured to receive a removably insertable weight 12. In one embodiment, the weight 12 has a removably attachable handle 28 to allow a user to insert and remove the weight 12 to and from the concave center 14, and to grasp the exercise device 1 when in use. The weight 12 when inserted in the concave center 14 provides added stability to the device. The weight 12 can sufficiently weigh the device down such that the device will not roll easily without a user providing a sufficient amount of force. This also serves as a safety feature of the device as it can prevent injury that may be experienced by a user over-extending themselves too quickly. The concave center 14 includes a main bearing 22 positioned in the lower end of the concave center. In one embodiment, the main bearing 22 is made up of a plurality of bearing balls 24 embedded in the lower end of the concave center. The top surface of the plurality of bearing balls 24 is at least partially exposed such that the weight can engage the tops of the bearing balls of the main bearing. In preferred embodiments, the bearing balls are constructed from a sufficiently durable and hard metal material. The bearing balls must be sufficiently hardened to withstand the downward force of the weight and additional downward forces that may be exerted by a user grasping the weight.

The removably insertable weight 12 may be freely removed from the concave center 14 of the carriage 10, and employed by the user in a separate exercise activity. For example, the weight 12 may weigh between 2 and 24 pounds, and be used as a medicine ball, or as a dumbbell might be used in many free weight exercises. The core of the weight 12 may include lead or concrete or other dense material to achieve a desired weight. The outer casing of the weight 12 may be formed from a smooth, hard material such as a metal or thermoplastic that will roll with minimal friction within the main bearing 22.

The main bearing 22 is thus configured for rolling engagement 23 with the weight 12, and the weight 12 is insertable within the concave center 14. The main bearing 22 embedded in the concave center 14 is configured to allow the weight 12 to rotate in place relative to the position of the user holding the handle. The main bearing 22 allows the insertable weight 12 to rotate 360-degrees about its vertical axis freely and fully. The main bearing 22 also allows the insertable weight 12 to rotate about any horizontal axis freely, although the angle of rotation of the weight about a horizontal axis will be limited by the top surface of the carriage 10. That is, the weight can rotate freely side-to-side and forward-and-backward until the handle contacts the top surface of the carriage, at which point the weight cannot rotate further. Thus, the rolling engagement between the main bearing 22 and the weight 12 causes the weight to have the ability to rotate 360-degrees in place about its vertical axis and freely rotate about its horizontal axis until contacting the carriage 10. The ability of the weight to rotate in place when inserted in the concave center allows a user to dynamically adjust the angle of the handle 28 with respect to the top surface 16 of the carriage 10 while the device is in use and rolling toward or away from the user. This can minimize the risk of injury to the user while exercising with the device. Particularly, this can minimize the strain exerted on a user's wrist, elbow and shoulder joints by allowing the user to dynamically adjust the angle with which they grip the exercise device by rotating the weight in the concave center as it is rolling along a surface.

The dimensions of the weight 12 are configured to substantially correspond to the dimensions of the concave center 14. This is to ensure there is a tight and secure fit between the weight and the concave center. In a preferred embodiment, the weight 12 has a substantially hemispherical shape. In another embodiment, the weight 12 has a substantially flat top surface 13. Defined substantially in the center of the flat top surface 13 is a handle attachment 26 configured to removably attach the handle 28 to the weight. The handle attachment may attach the handle via a turn-key locking system, a threaded engagement, a friction fit engagement, or any other conventional means for securing a handle to a liftable weight. Described in more detail below, the present invention includes several differing embodiments of a handle that may be used with the weight. Each handle configuration may be more useful for a particular exercise or stretch position that can be performed by a user with the present invention.

Opposite the top surface 16, the carriage 10 has a bottom surface 18. The bottom surface 18 has at least one roller 19. The roller 19 can be designed as a wheel freely rotating about a central connection point. Alternatively, the roller 19 may be designed as omnidirectional ball or spherical rollerball 20. The embodiments illustrated and discussed herein depict the roller 19 as a rollerball 20. In preferred embodiments, the rollerballs are constructed from a sufficiently durable and hard material, such as a metal or thermoplastic that will roll with minimal friction. The rollerball must be sufficiently hardened to withstand the downward force exerted by the carriage when in use. Preferably, there are at least three rollerballs 20. Each rollerball 20 is housed in a rollerball housing 42 integrally formed in the bottom surface of the carriage 10. The rollerballs 20 are configured to facilitate rolling engagement between the carriage 10 and a substantially planar surface.

Figure 2:
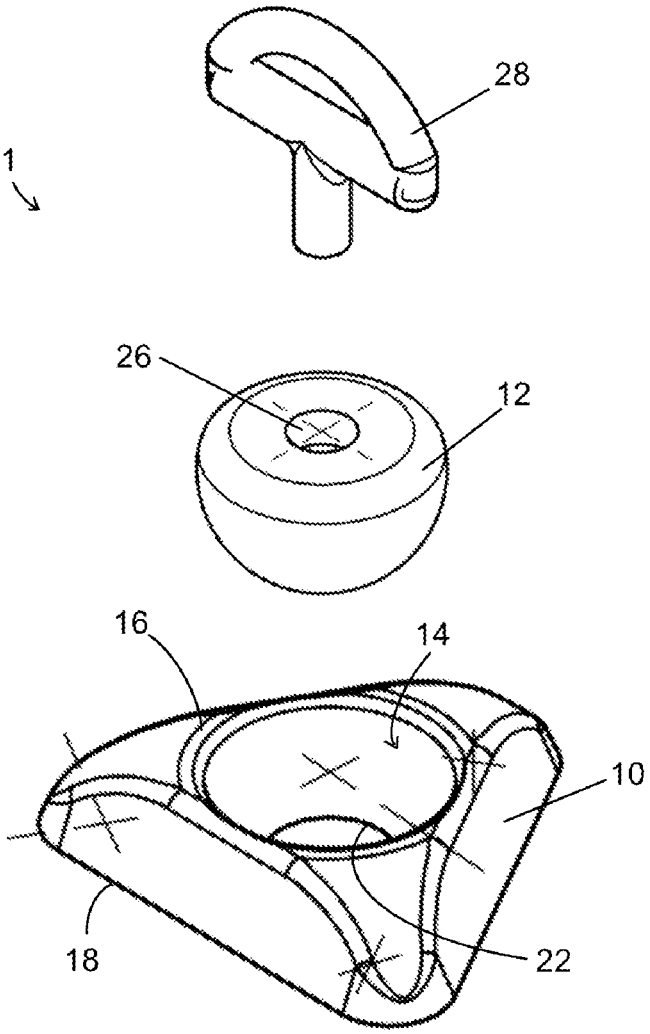
FIG. 2 is an exploded top perspective view of the embodiment shown in FIG. 1.

FIG. 2 is an exploded perspective view of the embodiment in FIG. 1. As illustrated, the concave center 14 of the carriage 10 is configured to receive the weight 12 therein. The weight 12 is configured for rolling engagement 23 with the main bearing 22 positioned at the inferior end of the concave center 14. The illustrated embodiment depicts the weight 12 with the removable handle 28. The weight 12 has a handle attachment 26 defined substantially in the center of the weight and configured to receive and securely attach the handle 28 to the weight 12.

Preferably, the weight 12 is configured with a hemispherical shape. The profile of the concave center 14 is configured to substantially correspond to the profile of the weight such that the weight may be readily inserted into the concave center. Thus, in a preferred embodiment, the concave center 14 is configured generally as a hollow hemisphere that has an overall profile corresponding to the overall profile of the hemispherical shaped weight. Those skilled in the relevant art will readily recognize that the shape of the removable weight and corresponding concave center may be configured as other geometric shapes without departing from the scope of the invention.

Figure 3:
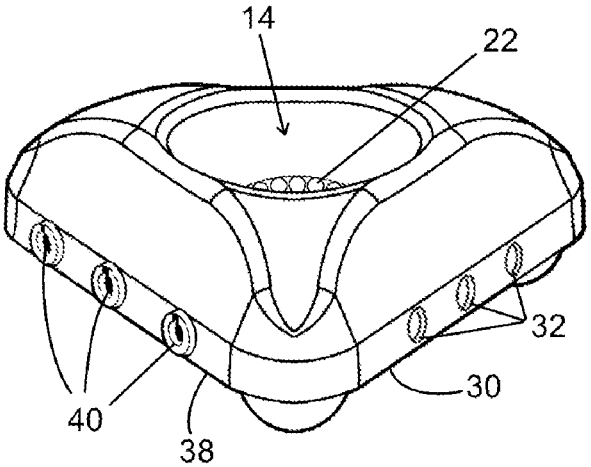
FIG. 3 is a top perspective view of an embodiment of a carriage according to the present invention.
Figure 4:
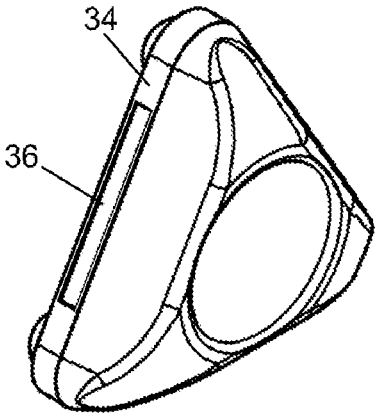
FIG. 4 is a perspective view of the carriage of FIG. 3 resting on a first side.
Figure 5:
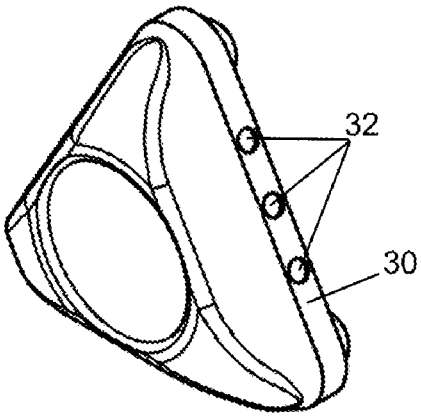
FIG. 5 is a perspective view of the carriage of FIG. 3 resting on a second side.
Figure 6:
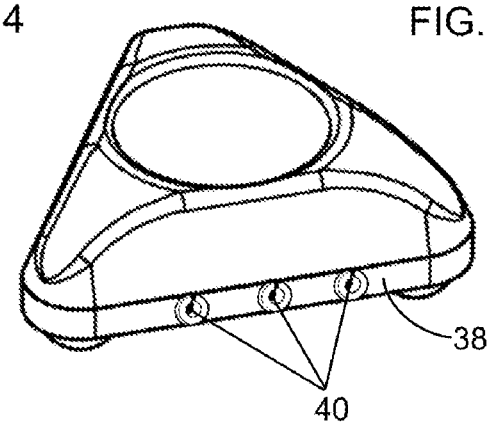
FIG. 6 is a perspective view of a third side of the carriage of FIG. 3.

FIG. 3 is a top perspective view of an embodiment of the carriage 10 of the present invention. As depicted, the removably insertable weight 12 has been removed from the carriage 10. FIGS. 4-6 illustrate varying side perspective views of the carriage 10. In the illustrated embodiment of the carriage, there are three distinct sides that form the carriage. In a preferred embodiment, each of the three distinct sides is configured with a functionally distinct embedded component or attachment. Alternatively, each side may have the same embedded component or attachment. In other embodiments, fewer than all sides may be configured with an embedded functional component, or no sides may have an embedded component or attachment.

With reference to FIGS. 4-6, the different sides of the carriage are described below. The carriage 10 has a first side 30. The first side 30 may be configured with at least one embedded strong earth magnet 32. Preferably, there is a plurality of strong earth magnets 32 embedded in the first side 30. The carriage also has a second side 34. The second side 34 may be configured with at least one embedded ferrous metal strip 36, such as a strip or bar made from carbon steel.

The magnets 32 of the first side 30 are configured for magnetic attachment to the metal strip 36 on a second device 1 or similar device, so that two devices may be coupled in tandem. This configuration allows a user to attach two or more personal exercise devices 1 together allowing them to roll and otherwise work together in unison. This configuration may be advantageous for certain exercises or stretches that a user may wish to perform. Additionally, this configuration can allow a user to increase the overall weight of the personal exercise device.

FIG. 6 depicts a perspective view of a third side 38 of the carriage. The third side 38 can be configured with at least one embedded attachment point 40. The attachment point 40 is configured to securely attach an external piece of exercise equipment, such as a resistance band, for use in conjunction with the personal exercise device 1. In one embodiment, attachment point 40 comprises a specialized hardware component that is insertable within a mounting hole or recess formed through the side 38 of the carriage 10.

The embedded components are preferably attached to the carriage via an adhesive material. Alternatively, the carriage may be molded with the embedded components already in place. Other alternative means for attaching the embedded components may also be used and will become apparent to those skilled in art without departing from the scope of the present invention.

Figure 7:
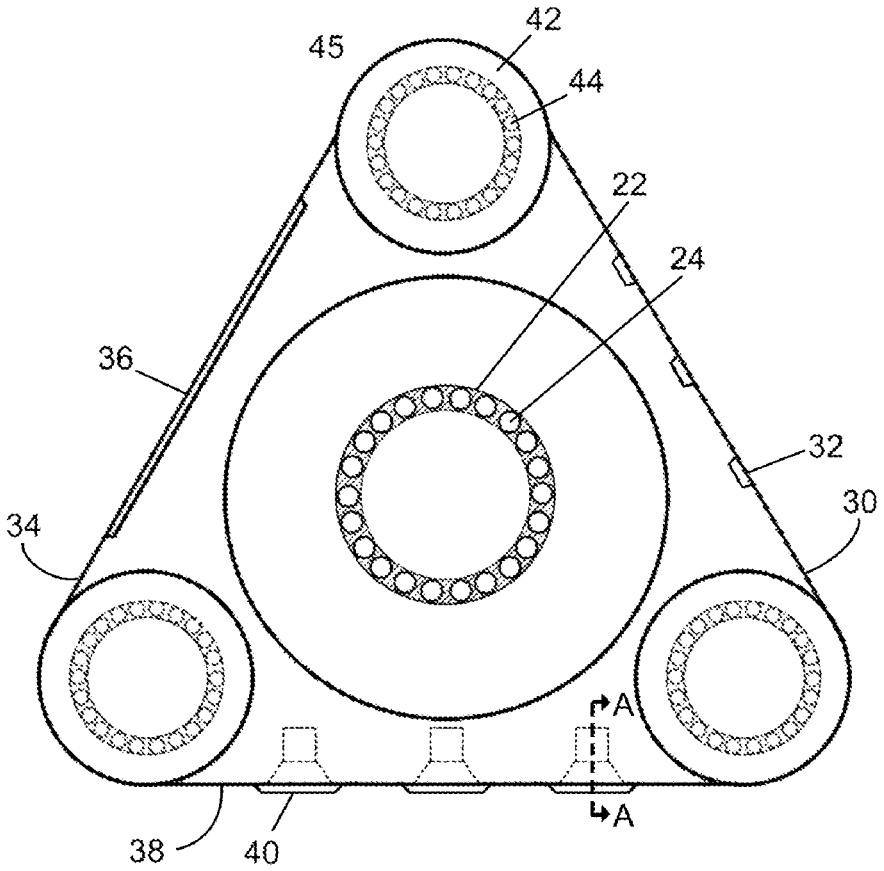
FIG. 7 is a transparent top view of one embodiment of a carriage according to the present invention.
Figure 8:
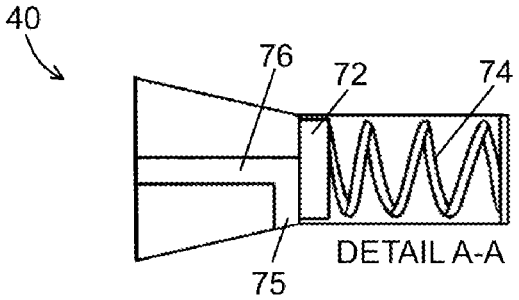
FIG. 8 is a cross-sectional view taken along section line A-A of FIG. 7.

As shown in FIG. 8, illustrating a cross-sectional view taken along lines A-A of FIG. 7, one embodiment of attachment point 40 has a hollow channel 76 extending a distance inward. At the inside end of the channel 76 is a locking channel 75. Proximate to the locking channel 75 is a spring-loaded retention plate 72 that is integrally connected to a compression spring 74. In operation, an external attachment key having an end corresponding to the attachment point 40 is inserted into the channel 76. Once fully inserted, the external attachment key pushes against the retention plate 72 causing the plate to move inward and expose the locking channel 75. The external attachment key can then be rotated until the profile of the external attachment key aligns with the profile of the locking channel. When relaxed, the external attachment key is held securely in place within locking channel 75 by the compression spring 74 pushing outward.

In an embodiment not depicted, the third side of the carriage may alternatively have an attachment point 40 configured as a post, a hook or a dowel embedded into side 38. The post, hook or dowel may be configured as an embedded anchor or attachment point for an external exercise band or other type of attachable exercise equipment. For example, the post may be a conventional eye-bolt configured to anchor a conventional carabiner that may be attached to an end of a piece of exercise equipment. In another example, the attachment point may be used to attach the device 1 in tandem to another device 1 or to a similar device.

FIG. 7 is a transparent top view of an embodiment of the carriage 10. In a preferred embodiment, the carriage 10 has three sides 30, 34, 38 that form an equilateral triangle. Each rollerball housing 42 is preferably positioned at a corner of the triangle formed by the three sides. However, the rollerballs 20 and rollerball housings 42 may be positioned in alternative configurations without departing from the scope of the invention. Similarly, in embodiments where the carriage has more than three sides, there may be additional rollerballs and rollerball housing positioned about the bottom surface.

The main bearing 22 is positioned in the inferior end of the concave center. Preferably, the main bearing 22 comprises a plurality of bearing balls 24. In a preferred embodiment, the main bearing 22 is configured as an embedded ring of bearing balls 24. The ring of bearing balls 24 is configured to facilitate rolling engagement with the weight 12.

FIG. 7 further illustrates that each rollerball 20 is preferably contained within a rollerball housing 42. Preferably, the diameter of each rollerball 20 is slightly larger than the diameter of the rollerball housing 42 to ensure a tight and secured fit therein. The rollerball housing 42 comprises at least one support bearing 45. In a preferred embodiment, the support bearing 45 is a ball bearing that comprises a plurality of bearing balls 44. The bearing balls of the support bearing are preferably constructed from the same material used to construct the bearing balls of the main bearing. Alternatively, the support bearing 45 may be configured as a sleeve bearing. The sleeve bearing is preferably constructed from a sufficiently hard and durable material, such as a metal, with minimal friction. Similar to the bearing balls, the sleeve bearing must be sufficiently hard to withstand the force exerted thereon while also minimizing friction to allow for sufficient rolling. The rollerball housing 42 is configured to facilitate rolling engagement between a rollerball 20 and the support bearing 45.

Figure 9:
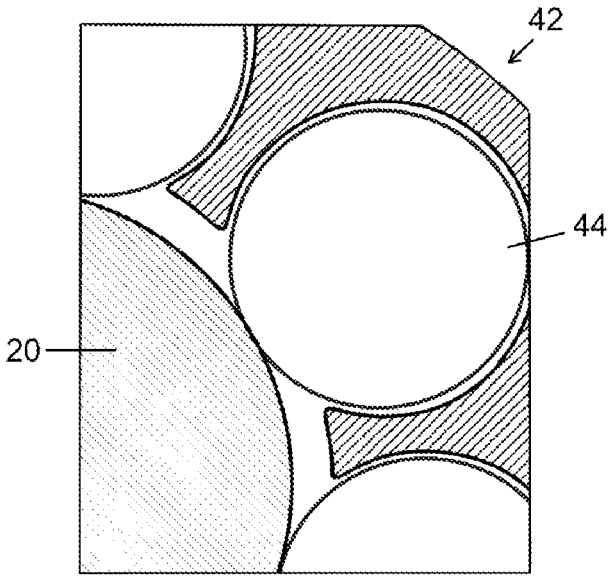
FIG. 9 is a magnified diagram of a rollerball and rollerball housing according to one embodiment of the present invention.
Figure 10:
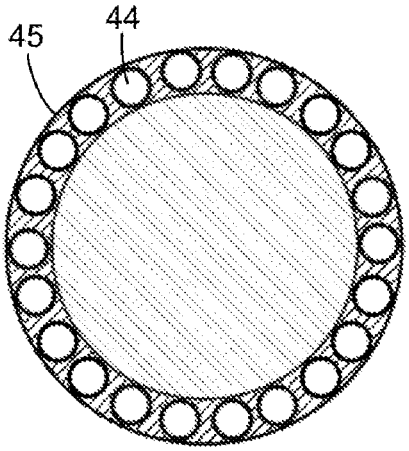
FIG. 10 is a diagram of an embodiment of a support bearing according to one embodiment of the present invention.
Figure 11:
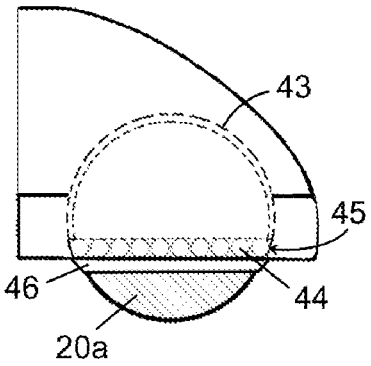
FIG. 11 is a transparent side view of one embodiment of a rollerball and rollerball housing.

FIGS. 9-11 illustrate varying views of one embodiment of the rollerball housing 42. FIG. 9 illustrates a magnified diagram of a rollerball 20 and rollerball housing 42. FIG. 10 illustrates a diagram of an embodiment of a support bearing 45 of the rollerball housing 42. FIG. 10 shows the support bearing 45 as a ball bearing having a plurality of bearing balls 44 in a circular encasement or race.

FIG. 11 shows a transparent side view of a first embodiment of a combination rollerball and rollerball housing. The rollerball housing 42 is configured to partially encircle the rollerball while leaving exposed a working end 20*a* of the rollerball to engage an external surface. In a preferred embodiment, the rollerball housing 42 has a support bearing 45 configured as a ball bearing and comprising a plurality of bearing balls 44 encased therein. The rollerball housing 42 has a defined top end 43 configured so that a rollerball 20 cannot be pushed entirely within the housing. In one example, the top end 43 may be configured as a spherical void designed to substantially match the dimensions the rollerball that is to be partially housed therein. The top end 43 may also provide a bearing surface against which the rollerball may work, so that a working end 20*a* remains exposed and capable of engagement with a planar surface. Preferably, the top end 43 of the rollerball housing is made from a hard, smooth material, such as a thermoplastic or fiberglass, to minimize friction between the top end and a rollerball. The rollerball housing 42 may further include a band 46. The band 46 may be positioned on the bottom side 18 of the carriage 10 and exterior to the support bearing. The band 46 is configured to further secure the rollerball 20 in the rollerball housing. The band 46 may be integral to the ball bearing assembly that encases bearing balls 44. Alternatively, the band 46 may be configured as a sleeve bearing.

FIGS. 12 to 15 illustrate various alternate embodiments of the rollerball and rollerball housing. The support bearing 45 of FIGS. 12 to 15 is illustrated as either a ball bearing 82 or a sleeve bearing 80, or may be a combination of two such bearings. Reference to the support bearing 45 will be made with specific regard to either the ball bearing 82 or the sleeve bearing 80 in the following descriptions. As illustrated, alternate embodiments of the rollerball housing depict the support bearing as being two support bearings, one upper support bearing and one lower bearing. The support bearings are positioned above and below a center point of the rollerball, as explained in more detail below. Reference to the center point (or central point) of the rollerball in the following description is to be understood to mean the center of the spherical rollerball from which all radii extend.

Figure 12:
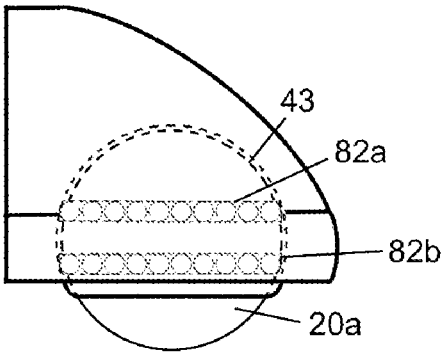
FIG. 12 is a transparent side view of a first alternative embodiment of a rollerball and rollerball housing.

FIG. 12 illustrates a first alternative embodiment of the rollerball housing. The rollerball housing of this embodiment has a first ball bearing 82*a* positioned superior to a center point of the rollerball and a second ball bearing 82*b* positioned inferior to the center point of the rollerball. Thus, the rollerball of this embodiment has a ball bearing on the top and bottom of the center point of the rollerball.

Figure 13:
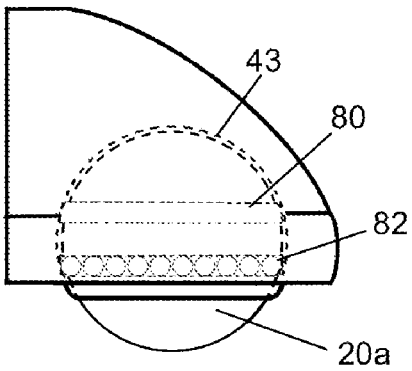
FIG. 13 is a transparent side view of a second alternative embodiment of a rollerball and rollerball housing.

FIG. 13 illustrates a second alternative embodiment of the rollerball housing. The rollerball housing of this embodiment has a first ball bearing 82 positioned inferior to the central point of the rollerball, and further includes a sleeve bearing 80 positioned superior to the central point of the rollerball. Thus, the rollerball of this embodiment has a sleeve bearing above the center point and ball bearing below the center point. The sleeve bearing of this embodiment may be configured as a spherical void providing a surface with which the rollerball may work against or may be a conventional sleeve bearing, as that term is commonly understood in the art.

Figure 14:
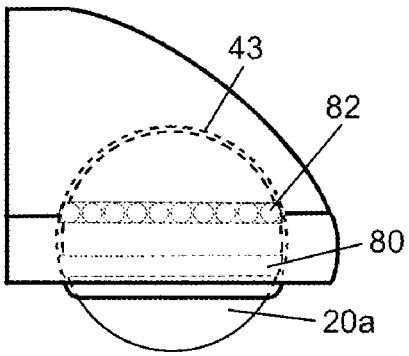
FIG. 14 is a transparent side view of a third alternative embodiment of a rollerball and rollerball housing.

FIG. 14 illustrates a third alternative embodiment of the rollerball housing. In the embodiment of FIG. 14, the ball bearing 82 may be superior and the sleeve bearing 80 may be inferior with regard to the central point of the rollerball.

Figure 15:
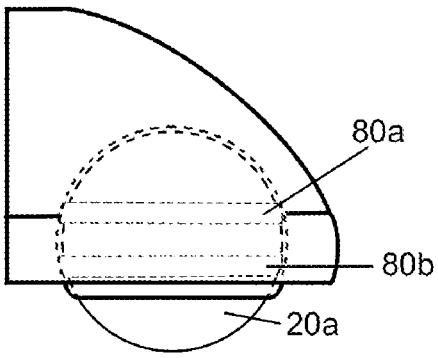
FIG. 15 is a transparent side view of a fourth alternative embodiment of a rollerball and rollerball housing.

FIG. 15 illustrates a fourth alternative embodiment of the rollerball housing. In this embodiment, a first sleeve bearing 80*a* is positioned superior to the central point of the rollerball and a second sleeve bearing 80*b* is positioned inferior to the central point of the rollerball. Thus, the rollerball of this embodiment has a sleeve bearing positioned on top and below the central point thereof. The superior sleeve bearing of this embodiment may be alternatively configured as a spherical void providing a surface with which the rollerball may work against or may be a conventional sleeve bearing, as that term is commonly understood in the art.

Figure 16:
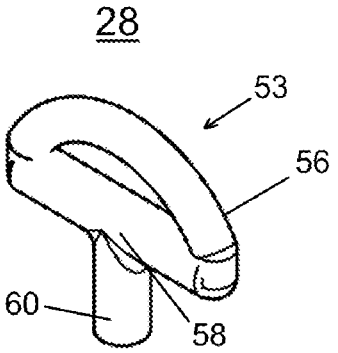
FIG. 16 is a perspective view of a first embodiment of a removable handle according to the present invention.

FIG. 16 is a perspective view of one embodiment of the handle 28, configured as a kettlebell handle 53, for removable attachment to the weight 12. The kettlebell handle 53 has an upper end that is configured as a curved or semicircular gripping bar 56. The gripping bar 56 is connected by a cross bar 58 having a perpendicular, downward extending arm 60. The downward arm 60 is configured to removably attach the kettlebell handle 53 to the handle attachment 26 on the weight 12. Attachment may be achieved by a turn-key style engagement, threaded engagement, friction fit engagement, or any other known means for removably attaching a handle to a weight.

Figure 17:
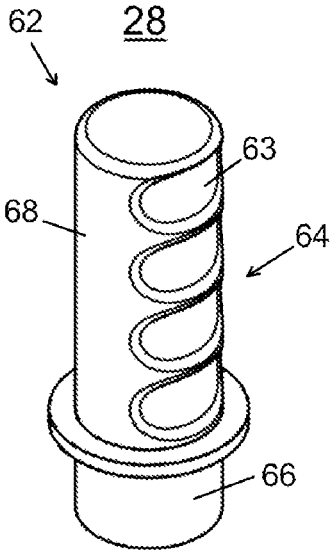
FIG. 17 is a perspective view of a second embodiment of a removable handle according to the present invention.

FIG. 17 is a perspective view of a second embodiment of a handle 28, configured as a joystick handle 62, for removable attachment to the weight 12. The joystick handle 62 is substantially cylindrical in shape and has a gripping side 64. The gripping side 64 has a plurality of notches 63 configured to provide a surface for a user to grip. The notches 63 preferably extend along substantially the entire vertical length of the gripping side 64. Opposite the gripping side, the joystick handle 62 has a smooth surface 68 rounding out the remaining cylindrical shape of the joystick handle. The joystick handle 62 further has a downward extending arm 66. The downward arm 66 is configured to removably attach the joystick handle 62 to the handle attachment 26 on the weight 12. Attachment may be achieved by a turn-key style engagement, threaded engagement, friction fit engagement, or any other known means for removably attaching a handle to a weight.

Figure 18:
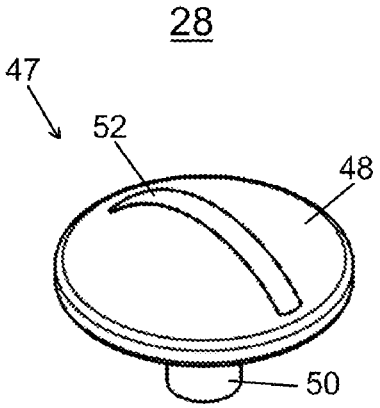
FIG. 18 is a perspective view of a third embodiment of a removable handle according to the present invention.

FIG. 18 is a perspective view of a third embodiment of a handle 28, configured as a flat handle 47, for removable attachment to the weight 12. The flat handle 47 has a flat top gripping surface 48. Preferably, the flat top gripping surface comprises a circular area, however, alternative shapes may also be used. Optionally, there may be a notched cutout 52 formed into the flat top gripping surface 48. The notched cutout 52 may provide a user an additional gripping surface along the middle plane of the handle as opposed to having to grip entirely around the handle 47, which may be beneficial to a user during the performance of certain exercises or stretches. The flat top handle 47 further includes a downward extending arm 50. The downward extending arm 50 is configured to securely attach the flat top handle 47 to the handle attachment 26 on the weight 12. Attachment may be achieved by a turn-key style engagement, threaded engagement, friction fit engagement or any other known means for removably attaching a handle to a weight.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An exercise apparatus comprising:

a carriage having at least three sides surrounding a top surface and a bottom surface, the top surface having a concave center configured to receive a weight, the weight configured for rolling engagement with a main bearing embedded in an inferior end of the concave center; and at least one rollerball at least partially encased in a rollerball housing, the rollerball housing formed in the bottom surface of the carriage and providing a support bearing configured for rolling engagement with the at least one rollerball.

2. The exercise apparatus of claim 1, wherein the main bearing further comprises a plurality of bearing balls.

3. The exercise apparatus of claim 1, wherein one of the sides of the carriage further comprises one or more strong earth magnets mounted therein.

4. The exercise apparatus of claim 1, wherein one of the sides of the carriage further comprises a ferrous metal strip embedded therein.

5. The exercise apparatus of claim 1, wherein one of the sides further comprises an attachment point, the attachment point configured to removably attach an external piece of exercise equipment.

6. The exercise apparatus of claim 5, wherein the attachment point is configured as a keyhole attachment having a first channel extending a distance inward and a second locking channel extending perpendicularly with respect to an inside end of the first channel, wherein the second locking channel is configured to retain an attachment upon rotation of the attachment after complete insertion of the attachment into the first channel.

7. The exercise apparatus of claim 1, wherein one of the sides of the carriage further comprises one or more strong earth magnets embedded therein, wherein a second one of the sides further comprises a ferrous metal strip embedded therein, and wherein a third one of the sides further comprises an attachment point, wherein the attachment point is configured to removably attach an external piece of exercise equipment.

8. The exercise apparatus of claim 1, wherein each side of the carriage further comprises an embedded component, wherein the embedded component of each side is functionally distinct from the embedded component of the other sides.

9. The exercise apparatus of claim 1, wherein the weight further comprises a removably attachable handle.

10. The exercise apparatus of claim 1, wherein the support bearing comprises an upper support bearing positioned above a central point on the at least one rollerball and a lower support bearing positioned below the central point on the at least one rollerball.

11. The exercise apparatus of claim 10, wherein at least one of the upper support bearing or the lower support bearing comprises a ball bearing.

12. The exercise apparatus of claim 10, wherein at least one of the upper support bearing or the lower support bearing comprises a sleeve bearing.

13. The exercise apparatus of claim 1, wherein the weight has a hemispherical shape configured to substantially correspond to the concave center of the carriage.

14. The exercise apparatus of claim 1, wherein the carriage comprises three sides that form an equilateral triangle.

15. The exercise apparatus of claim 14, wherein the carriage comprises three rollerballs each positioned at a different corner of the carriage.

16. The exercise apparatus of claim 1, wherein the weight is configured to allow for dynamic adjustment of the angle of the weight with regard to the carriage when the weight is inserted into the concave center.

17. An exercise apparatus comprising:

a triangular-shaped carriage having a top surface with a concave center having a plurality of bearing balls encased in a main bearing, wherein the concave center is configured to receive an insertable weight; and the triangular carriage having a bottom surface, the bottom surface having at least one roller configured to support the carriage on a horizontal surface and allow the carriage to move in any horizontal direction along the surface.

18. The exercise apparatus of claim 17, wherein each side of the triangular shaped carriage further comprises an embedded component, wherein the embedded component of each side is functionally distinct from the embedded component of the other sides.

19. An exercise apparatus comprising:

a carriage having at least three sides surrounding a top surface and a bottom surface, wherein each of the at least three sides is configured with an embedded component functionally distinct from components embedded in all other sides of the at least three sides;

the top surface having a concave center configured to receive a weight, the weight configured for rolling engagement with a main bearing positioned in an inferior end of the concave center; and at least one rollerball at least partially encased in a rollerball housing formed in the bottom surface of the carriage and configured for rolling engagement with a support bearing.

20. The exercise apparatus of claim 19, wherein the support bearing comprises an upper support bearing and a lower support bearing, wherein one of the upper support bearing or the lower support bearing is configured as a ball bearing and the other of the upper support bearing or the lower support bearing is configured as a sleeve bearing.

* * * * *